United States Patent [19]

Redford

[11] 3,978,925

[45] Sept. 7, 1976

[54] METHOD FOR RECOVERY OF BITUMENS FROM TAR SANDS

[75] Inventor: David A. Redford, Fort Saskatchewan, Canada

[73] Assignee: Texaco Exploration Canada Ltd., Calgary, Canada

[22] Filed: June 21, 1974

[21] Appl. No.: 481,582

[52] U.S. Cl. ..... 166/261; 166/272

[51] Int. Cl.[2] ..... E21B 43/24

[58] Field of Search ..... 166/256, 259, 261, 272, 166/303

[56] References Cited

UNITED STATES PATENTS

| | | | |
|---|---|---|---|
| 2,839,141 | 6/1958 | Walter | 166/261 |
| 3,209,825 | 10/1965 | Alexander et al. | 166/261 |
| 3,292,702 | 12/1966 | Boberg | 166/303 |
| 3,375,870 | 4/1968 | Satter et al. | 166/259 |
| 3,400,762 | 9/1968 | Peacock et al. | 166/259 |
| 3,409,077 | 11/1968 | Durie | 166/256 |
| 3,411,575 | 11/1968 | Connally | 166/259 |
| 3,411,578 | 11/1968 | Holmes | 166/256 |
| 3,500,913 | 3/1970 | Nordgren et al. | 166/259 |
| 3,605,890 | 9/1971 | Holm | 166/272 |
| 3,680,634 | 8/1972 | Peacock et al. | 166/261 |

*Primary Examiner*—Ernest R. Purser
*Assistant Examiner*—Jack E. Ebel
*Attorney, Agent, or Firm*—T. H. Whaley; C. G. Ries; Charles L. Bauer

[57] ABSTRACT

A method for the recovery of low gravity viscous oils or bitumens from a subterranean formation by the injection of a mixture of an oxygen-containing gas and steam to establish a hot communications path, followed by a shutting in of the wells for a period to allow the oxygen to react with the oil or bitumen in the formation and thereafter recovering the oil or bitumens via the production well. The cycle may thereafter be repeated.

10 Claims, No Drawings

METHOD FOR RECOVERY OF BITUMENS FROM TAR SANDS

BACKGROUND OF THE INVENTION

This invention relates to a method for recovering hydrocarbons from a subterranean hydrocarbon-bearing formation containing low gravity viscous oils or bitumens. More particularly, this invention relates to recovery of hydrocarbons from tar sands.

The recovery of viscous oils from formations and bitumens from tar sands by conventional methods has generally been unsuccessful because of the high viscosity and low mobility of the oil. While some success has been realized in recovering heavy oils by the use of thermal methods, essentially no success has been realized in recovering bitumens from tar sands. Bitumens can be regarded as highly viscous oils having a gravity in the range of about 5° to 10° API and contained in an essentially unconsilidated sand. These formations containing bitumens are referred to as tar sands. One such deposit is Athabasca tar sand located in Alberta, Canada, which is estimated to contain several hundred billion barrels of oil.

Among the conventional thermal recovery methods applied to produce viscous hydrocarbons from formations and bitumens from the tar sands are steam injection, hot water injection and in-situ combustion. Typically, such thermal techniques employ an injection well and a production well traversing the oil-bearing or tar sand formation.

In a steam operation utilizing two wells, steam is introduced into the formation through the injection well. Upon entering the formation, the heat transferred to the formation by the hot fluid functions to lower the viscosity of oil and improve its mobility while the flow of the hot fluid functions to drive the oil toward the production well from which it is produced.

In the conventional in-situ combustion operation, an oxygen-containing gas such as air is introduced into the formation via a well and combustion of the inplace crude adjacent the wellbore is initiated by one of many accepted means, such as the use of a downhole gas fired heater or a downhole electric heater or chemical means. Thereafter, the injection of the oxygen-containing gas is continued so as to maintain a combustion front which is formed and to drive the front through the formation toward the production well. As the combustion front advances through the formation, a swept area consisting ideally of a clean sand matrix, is created behind the front. Ahead of the advancing front various contiguous zones are built up. These zones may be envisioned as a distillation and cracking zone, a condensation and vaporization zone, an oil bank and a virgin, or unaltered zone.

The temperature of the combustion front is generally in the range of 750–1100°F., which is generated by combustion of coke-like materials deposited on the matrix of the formation. The heat so produced is transferred ahead of the front, where it not only heats the in-place hydrocarbons, but also results in some cracking and distillation of the crude or bitumen.

Ahead of the distillation and cracking zone is a condensation and vaporization zone. This zone is a thermal plateau and its temperature is in the range of from about 200° to about 450°F., depending upon the pressure and the distillation characteristics of the fluid therein. These fluids consist of water and steam and hydrocarbon components of the crude.

Ahead of the condensation and vaporization zone is an oil bank which forms as the in-situ combustion progresses and the crude is displaced toward the production well. This zone of high oil saturation contains not only reservoir fluids, but also condensate, cracked hydrocarbons and gaseous products of combustion which eventually reach the production well from which they are produced.

Various improvements are set forth in the prior art that relate to the injection of water, either simultaneously or intermittently with the oxygen-containing gas to scavenge the residual heat in the formation behind the combustion front, thereby increasing recovery of oil. Prior art also teaches regulating the amount of water injected so as to improve conformance or sweep and to control the combustion.

Despite the use of these thermal recovery techniques none has been particularly successful since long periods of time and considerable amounts of thermal energy are required to heat up a formation sufficiently to obtain the desired reduction in viscosity and improved mobility.

When these thermal techniques have been applied to the tar sands additional problems arise since not only do the tar sands have a low gravity, i.e., 6°–8°API and a higher viscosity, i.e., in the millions of centipoises, but also their permeability is so low that difficulty has been experienced in establishing fluid communication within the formation.

It is an object of the present invention to overcome the difficulties experienced in the application of thermal methods to recovery of heavy oils or bitumens from tar sands, by the use of a low temperature oxidation or controlled combustion method utilizing the injection of an oxygen-containing gas and steam.

SUMMARY OF THE INVENTION

This invention relates to a method of recovering low API gravity viscous oils or bitumens from a subterranean formation by the injecting of a mixture of an oxygen-containing gas and steam to establish a hot communications path and thereafter shutting in the wells until the oxygen in the gas has reacted with the formation hydrocarbons and then recovering the oil or the bitumens via the production well. The cycle may be repeated when the bitumen production falls appreciably.

DESCRIPTION OF THE PREFERRED EMBODIMENT

We have found that bitumens in tar sands can be recovered by the use of a mixture of an oxygen-containing gas and steam to produce a low temperature oxidation or controlled combustion in the formation at a temperature much lower than the temperatures that occur in the conventional in-situ combustion process. In a broad aspect of the invention, a hydrocarbon-bearing formation such as a tar sand is first traversed by at least one injection well and one production well. A fluid communications path is established between these wells, and thereafter a mixture of an oxygen-containing gas and steam is injected. At the temperature of the injection mixture, a low temperature oxidation is caused to occur along the communications path so as to raise the temperature therein to the range of about 250°–500°F. Injection is continued until unreacted oxygen is produced from the production well. Thereafter the injection and production wells are shut in for a time sufficient to allow the oxygen remaining in the formation to be consumed by low temperature oxidation of the bitumen and to dissipate the heat thus formed into the formation. The production well is then returned to production. When the rate of production falls appreciably, the injection of the mixture of the oxygen-containing gas and the steam is again initiated and the cycle is repeated.

The concept of the invention can be realized when the inventors' technique is contrasted with the conventional in-situ combustion process. In the conventional in-situ combustion process, as applied to heavy oils, because of the high percentage of heavy ends in a viscous oil or bitumen, the front advances at a slow rate and heavy coking occurs during its movement. This heavy coking results in much of the in-place hydrocarbons being carbonized, with the result that higher fuel consumption and lower oil recovery occurs. This high coking also may cause a decrease in the permeability of the formation to a point that may result in extinguishing the process. With the instant invention, a form of coking occurs under low temperature conditions, but this coke is not appreciably consumed by the oxygen, and hence that oxygen is able to bypass this coke largely unreacted and react further in the formation. By this invention the oxygen required to move the combustion front through the formation is significantly reduced. With this type of oxidation reaction, blockage due to excessive carbonization does not occur.

An added advantage is that with the visbreaking and mobility improvement ahead of the front, the degraded hydrocarbons are mobile and are transported into the virgin formation where they serve to dilute the in-place hydrocarbons and improve their mobility.

The redistribution of the oxidative reactions and the increase in the advance of the front have been accomplished by lowering the temperature to control the combustion.

It is postulated that the oxidation that occurs by the simultaneous use of steam and oxygen-containing gas may be explained in terms of oxidative molecular degradation that is not necessarily a combustion of all of the large asphaltic molecules such as are known to be present in tar sands. The mechanism may be explained in terms of cleavage of asphaltic clusters resulting in a hydrocarbon having a relatively low molecular weight, which has greater mobility. The molecular degradation may result from mild thermal cracking, termed visbreaking.

We have found that this procedure will initiate the low temperature oxidation or controlled combustion without having to use electric downhole heaters, downhole gas burners or chemical ignition methods.

To illustrate the invention, a series of laboratory tests was performed using a tar sand from the McMurray formation in Alberta, Canada. Approximately 170–190 lbs. of tar sand was packed in a cell approximately 15 inches long and 18 inches in diameter. The cell was equipped for operating at controlled temperatures up to 420°F. and pressures of 300 psi, and contained simulated suitable injection and production wells. In addition, the cell contained many thermocouples, so that temperatures throughout the cell could be measured, and heat transfer rates could be calculated. A communications path consisting of clean 20–40 mesh sand was placed between the simulated wells, and fluid communication was established prior to commencement of a test by the injection of nitrogen.

In a typical run the pressure was maintained at 300 psi during the test. Low temperature oxidation was established by simultaneous injection of air and steam at a temperature of about 417°F., the temperature of saturated steam. The following table shows the results.

| Run | Fluids Injected | Injection Pressure (psi.) | Injection Temp. (°F.) | Time (hrs.) | Prod'n Rate(a) (lb/hr.) | Recovery |
|---|---|---|---|---|---|---|
| 1 | Steam | 300 | 417 | 9 | 0.56 | 22(b) |
| 2 | Steam(c) | 300 | 417 | 6.5 | 0.52 | 22(b) |
| 3 | Air/Steam(d) | 300 | 417 | 7.5 | 1.10 | 30(b) |
| 4 | Air/Steam(e) | 300 | 417 | 25 | 0.99 | 47 |

(a) At 14% recovery
(b) Normalized to termination at 96% water production
(c) Soak period after 3 hrs. with pressure decline; followed by injection of steam
(d) No soak periods
(e) After 15 hrs., cycle with 20 min. injection. 20 min. soak and 10 min. draw-down for 10 hrs.

The results show that use of air with steam (Runs 3 and 4) sharply increases the recovery rate at the 14% recovery point, and increased total recovery as compared to using steam only (Runs 1 and 2).

Introduction of soak periods in which the air has a longer time to react with the bitumen (Run 4) sharply increases the total recovery from the run.

The communications path may be established which will accept steam and air so that a hot zone may be established which is necessary before any bitumen flows. The path may be established by conventional hydraulic fracturing methods or by the use of solvents.

The oxygen-containing gas may be air, enriched oxygen, or substantially pure oxygen. Enriched oxygen would include oxygen admixed with non-condensible inert gases such as nitrogen, carbon dioxide or flue gas. The steam may be either saturated or superheated, but preferably should be in the range of temperature of about 250°F. to 500°F.

In summary, in accordance with the invention, recovery of heavy oils or bitumens from subterranean formations is accomplished by the creation of a fluid communications path between two wells that traverse the formation, and thereafter a mixture of an oxygen-containing gas and steam is injected so as to impart heat to the communications path, by a low temperature combustion at a temperature oxidation or controlled in the range of 250°–500°F. Thereafter the wells are shut in so that the oxygen present may be consumed by reaction with the bitumens and the heat may be dispersed in the formation. The wells are then placed on production and the cycle is repeated after production has fallen to a low level.

We claim:

1. A method for the recovery of hydrocarbons from subterranean hydrocarbon-bearing formations traversed by at least one injection well and one production well and having fluid communication therebetween, comprising the steps of:

a. injecting via said injection well into said communications path a mixture of steam and an oxygen-containing gas, said mixture being injected at a temperature in the range of 250°-500°F., thereby generating a low temperature oxidation therein, b. continuing injection of said mixture until unreacted oxygen is produced at said production well, c. shutting in said two wells to allow the oxygen of said oxygen-containing gas to be consumed in said low temperature oxidation reaction with said hydrocarbons in said formation, d. thereafter producing said hydrocarbons from said production well.

2. The method of claim 1 wherein said oxygen-containing gas is air.

3. The method of claim 1 wherein said oxygen-containing gas is substantially pure oxygen.

4. The method of claim 1 wherein the oxygen-containing gas comprises oxygen, nitrogen, carbon dioxide, flue gas and mixtures thereof.

5. The method of claim 1 wherein steps a through d are repeated, when the production of said hydrocarbons falls to a low level.

6. The method of claim 1 wherein production occurs from the said injection well and said production well after said shut-in period.

7. The method of claim 1 wherein said steam is saturated.

8. The method of claim 1 wherein said steam is superheated.

9. The method of claim 1 wherein said formation is first repressured to a pressure corresponding to a temperature of saturated steam in the range of 250°F. to 500°F.

10. A method for the recovery of hydrocarbons from a hydrocarbon-bearing formation which is traversed by an injection well and a production well, comprising the steps of:

a. establishing a fluid communications path between said two wells;

b. injecting via said injection well a mixture of steam and a gas comprising principally oxygen at a temperature of 250°–500°F. until a hot path is created between said two wells and free oxygen is produced at said production well;

c. shutting in said injection and production wells for a time to permit said oxygen to be consumed in a low temperature oxidation reaction with said formation hydrocarbons;

d. producing said hydrocarbons from said production well;

e. repeating steps *b*, *c* and *d* when the rate of production has substantially declined.

* * * * *